US006812654B2

(12) United States Patent
Koga et al.

(10) Patent No.: US 6,812,654 B2
(45) Date of Patent: Nov. 2, 2004

(54) FIELD EMISSION TYPE ELECTRON SOURCE ELEMENT, ELECTRON GUN, CATHODE RAY TUBE APPARATUS, AND METHOD FOR MANUFACTURING CATHODE RAY TUBE

(75) Inventors: Keisuke Koga, Souraku-gun (JP); Toru Kawase, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/399,738

(22) PCT Filed: Oct. 24, 2001

(86) PCT No.: PCT/JP01/09317

§ 371 (c)(1),
(2), (4) Date: Sep. 2, 2003

(87) PCT Pub. No.: WO02/35573

PCT Pub. Date: May 2, 2002

(65) Prior Publication Data

US 2004/0051461 A1 Mar. 18, 2004

(30) Foreign Application Priority Data

Oct. 25, 2000 (JP) ..... 2000-325300

(51) Int. Cl.[7] ..... G09G 1/04

(52) U.S. Cl. ..... 315/370; 315/368.11; 315/368.15; 313/364; 313/497; 313/387

(58) Field of Search ..... 315/169.3, 169.1, 315/366, 368.11, 368.15, 368.16, 368.27, 370, 382; 313/364, 387, 497, 500

(56) References Cited

U.S. PATENT DOCUMENTS 4,155,030 A * 5/1979 Chang ..... 315/169.3
4,178,531 A * 12/1979 Alig ..... 313/409
5,170,101 A * 12/1992 Gorski et al. ..... 315/368.11

FOREIGN PATENT DOCUMENTS

| | | |
|---|---|---|
| JP | 52-123831 | 10/1977 |
| JP | 57-187849 | 11/1982 |
| JP | 63-037543 | 2/1988 |
| JP | 07-147129 | 6/1995 |
| JP | 07-235258 | 9/1995 |
| JP | 08-171880 | 7/1996 |
| JP | 2000-164161 | 6/2000 |

* cited by examiner

*Primary Examiner*—Haissa Philogene

(57) ABSTRACT

The object of the present invention is to provide a field emission device that emits an electron beam bundle whose spot profile on a display screen has as little distortion as possible, and that maintains a stable electron emission property regardless of the length of a driving time, a CRT apparatus equipped with such field emission device, and a production method of such CRT apparatus.

The field emission device (10) has, on a surface of a substrate (11), a plurality of cathode electrodes (12) parallel to each other, an insulation layer (13), and a plurality of extraction electrodes (14) parallel to each other, in the stated order, the cathode electrodes (12) and the extraction electrodes (14) being orthogonal to each other and so yielding a plurality of crossover regions.

At the crossover regions, electron emission zones (15) each made up of four emitters (16) are formed. One or more of the electron emission zones (15) are selected by controlling the applied voltage between the cathode electrodes (12) and the extraction electrodes (14), according to an area of the display screen to be irradiated with the electron beam bundle.

46 Claims, 15 Drawing Sheets

PRIOR ART

PRIOR ART

FIELD EMISSION TYPE ELECTRON SOURCE ELEMENT, ELECTRON GUN, CATHODE RAY TUBE APPARATUS, AND METHOD FOR MANUFACTURING CATHODE RAY TUBE

FIELD OF INVENTION

The present invention relates to a field emission device, an electron gun, a cathode ray tube apparatus, and a method of producing a cathode ray tube.

BACKGROUND ART

In recent years, flat display panels have started to be rapidly spread in the market. However, in the field of televisions of about 32 inches intended for home use, displays with cathode ray tubes (hereinafter "CRT") still have an edge, with all things considered such as price and performance.

CRTs are provided with an electron gun as an electron emission source.

Conventional electron guns include a thermal cathode made up of a nickel cylinder in which a heater is placed, whose outer surface is covered with oxide that is mainly composed of barium oxide (BaO).

In the electron gun, an oxide layer will emit electron beams by being applied heat from the heater of the thermal cathode.

Displays are required to have a high-resolution performance, in order to deal with environmental changes such as full-scale introduction of terrestrial digital broadcasting. In order to realize a high-resolution performance in CRTs, it is necessary to improve current density at the thermal cathode. In fact, an extent of improvement required for the current density is great as much as by 6 to 10 times the normal thermal cathode currently used for CRTs.

There have already been attempts for improving current density at the thermal cathode, such as by technically improving materials, which, however, are reaching the physical limit. That is, with CRT, it has come to a point where it is difficult to dramatically improve the current resolution.

On the other hand, research and development has started recently attempting to replace the thermal cathode with a cathode equipped with a field emission device.

A cathode equipped with a field emission device is characterized by inherently having high current density compared to a thermal cathode, therefore has been used for some products such as electron microscopes.

The field emission device has a structure in which a cathode electrode and an extraction electrode, both being a thin film, are formed in the stated order on a substrate, and having at least one emitter being a protrusion in a shape of cone on the cathode electrode. The extraction electrode has an opening above the emitter, and is electrically insulated from the cathode electrode by an insulating layer formed between the extraction electrode and the cathode electrode.

The cathode including this field emission device emits electron beams towards the anode (towards the screen in a CRT), by being applied voltage that exceeds a threshold value between the extraction electrode and the cone-shape emitter. The luminance is adjusted by altering the voltage to be applied.

The aforementioned cathode can operate with high current density, which was not possible with the thermal cathode. Furthermore, the CRT equipped with such a cathode in its electron gun has excellent characteristics in luminance and resolution.

Here, it is noted that the conventional CRTs have a problem in that, even with use of a field emission device as their cathode, the profile of electron beam on the screen (spot profile) will be distorted towards the edge of the screen. Such distortion in electron beams is more pronounced with higher luminance.

This problem with CRTs regarding the distortion of the spot profile of the electron beam is detailed with FIG. 14 as follows. FIG. 14 is a plan view showing a spot profile of the electron beam on each area of the CRT screen.

The spot profile of the electron beam, being largely affected by the horizontal deflection magnetic field generated by the deflection yoke, is changed according to an area of the screen which is irradiated with the electron beam as shown in FIG. 14.

As depicted in FIG. 14, in the center of the screen, the spot profile P1 is yielded in a perfect circle form; and on the edges of the screen (either left or right of the screen in FIG. 14), the spot profile P2 is yielded in a laterally-long oval form.

Furthermore, in corner parts of the edges of the screen (either upper or lower parts), the spot profile P3 is yielded in an oval form being long in a slanting direction.

The aforementioned distortion in spot profiles of the electron beam is generated since the collision angle of the electron beam on the screen is different according to each position of the screen. This is because the electron beam emitted from the electron gun comes into collision with the screen, after being deflected by the deflection magnetic field that is a combination of a horizontal deflection magnetic field and a vertical deflection magnetic field.

The electron beam having distortion in a horizontal direction, in particular, will greatly deteriorate an effective resolution of a CRT.

As shown in FIG. 14, the spot profile of the electron beam is largely affected by the horizontal deflection magnetic field of a deflection yoke.

In order to solve this problem, an electron gun whose electron lens is equipped with a quadrupole lens has been proposed. However, such electron gun is problematic because of the cost increase due to the increase in parts.

Under such circumstances, Japanese Laid-open Patent Application H07-147129 disclosed a technology for improving the distortion in spot profiles without using a quadrupole lens.

The structure of the cathode disclosed by this prior art is shown in FIG. 15.

In FIG. 15, three electron emission areas 515*a*, 515*b*, and 515*c* are formed on a surface of a substrate 511. The form of each electron emission area is as follows: the electron emission area 515*a* that positions in the center has a perfect circle form; and the electron emission areas 515*b* and 515*c*, each positioning at top and bottom, have a crescent form. A cathode electrode 512*a* is connected to the electron emission area 515*a* positioning in the center, and a cathode electrode 512*b* is connected to the other electron emission areas 515*b* and 515*c*. The cathode electrode 512*b* is electrically separate from the cathode electrode 512*a*.

This cathode emits electron beams directed to the center of the screen, only from the electron emission area 515*a*, and emits electron beams directed to the edge areas of the screen, from all the electron emission areas 515*a*, 515*b*, and 515*c*.

That is, this cathode is able to emit the electron beam having a perfect circle form, for the center of the screen, and to emit the electron beam having an oval form which is long in a vertical direction, for the edge areas of the screen.

Although the disclosed technology is able to improve the distortion of the electron beam to some extent, it cannot perform an appropriate correction to the distortions created throughout the screen, because the forms of the electron emission areas are limited to two patterns, either a perfect circle form or an oval form which is long in a vertical direction. More specifically, the aforementioned technology is not able to either perform a correction for horizontally distorted spot profiles, or an appropriate correction according to each position at the screen.

Furthermore, the cathode, having a field emission device, has a problem that the electron emitting performance will decrease as an elapse of driving time of the device.

When the degree of vacuum in the CRT is low, the electron emitted from the field emission device comes into collision with the gas remaining within the tube, thereby generating ions, and the generated ions come into collision with the surface of the field emission device, resulting in the device being damaged. The device damaged in the above way will have degraded electron emission performance, and will cause luminance deterioration.

As seen in the above, one reason causing the deterioration in the device is the generation of ions due to the low degree of vacuum within the CRT. Generally, the degree of vacuum in a CRT is about $10^{-5}$(Pa). Currently, a great improvement cannot be expected in the vacuum degree due to a limitation in the production process and the like.

Another reason causing the deterioration in the device is a current density at the time of operating the cathode. Within a CRT, a field emission device in its operating state may be driven at a current density of about 10(A/cm$^2$). This value is one digit larger than the value of the thermal cathode.

If only for achieving an object of preventing the device deterioration, the current density of the device may be kept low. However, in view of the object for maintaining high luminance as mentioned earlier, the current density for the device should not be low.

DISCLOSURE OF INVENTION

The object of the present invention, in view of the stated problems, is to provide a field emission device that emits an electron beam bundle whose form on the display surface has little distortion, and that is able to maintain a stable electron emission property regardless of a length of time for which the device has been driven. The present invention also intends to provide a cathode ray tube apparatus equipped with such field emission device, and a method of producing a cathode ray tube equipped with such field emission device.

In order to achieve the stated object, the present invention is characterized by a field emission device that emits electron beams in a bundle to be scanned over a screen, including: a plurality of electron emission zones arranged two-dimensionally, each of which is driven independently of the other electron emission zones and emits an electron beam by means of an electric field.

In the Japanese laid-open patent application H07-147 129, an electron emission area is divided into three or more in advance. The cathode having such electron emission area corrects distortion of a spot profile of the electron beam, by driving each divided area independently of the other areas. However, such cathode is only able to correct the distortion in one direction that has been set in advance.

On the other hand, in the field emission device of the present invention, a plurality of electron emission zones are provided two-dimensionally, each of which is driven independently. Therefore, by arbitrarily selecting electron emission zones located in a matrix configuration and driving the selected electron emission zones, the spot profile of the resulting electron beam bundle can be corrected in a horizontal direction as well as in a vertical direction (i.e. scanning direction of an electron beam). Accordingly, the field emission device of the present invention is superior to the cathode in the aforementioned prior art, in that it can emit electron beam bundles whose spot profile is not distorted much, on any part of the screen.

Here, each of the plurality of electron emission zones according to the present invention is able to emit an electron beam independently of each other, and selection of appropriate electron emission zones from which electron beams are emitted in a bundle is possible with the present invention so as to yield a spot profile on the screen having little distortion, according to an area of the screen to be irradiated with the electron beam bundle. In addition, the configuration in which the electron emission zones are disposed is two-dimensional, unlike the one-dimensional configuration depicted in the aforementioned FIG. 15. The electron emission zones disposed in this way each correspond to the three electron emission zones depicted in FIG. 15.

Here, it should be noted that many electron emission zones are provided with a plurality of electron-beam emitters disposed two-dimensionally. However, an emitter cannot emit an electron beam independently of each other, therefore does not correspond to the electron emission zone of the present invention.

Here, it is desirable that the electron emission zones are each made up of at least one emitter.

It is also desirable that the electron emission zones are arranged in a matrix configuration.

Concretely, the field emission device of the present invention desirably has, in addition to the emitters, a substrate, a plurality of row electrodes provided parallel to each other on the substrate, and a plurality of column electrodes parallel to each other and provided over the plurality of row electrodes with an insulating layer in-between, the column electrodes crossing over the row electrodes, where the at least one emitter is disposed at each of crossover portions formed between the row electrodes and the column electrodes, so as to protrude from a row electrode. The stated construction is desirable in view of driving each one of the electron emission zones independently, without a complicated control circuit.

Specifically, the emission of such electron beam bundle from such electron emission zones is made possible by controlling voltage applied between row electrodes and column electrodes.

In addition, the electron gun of the present invention emits an electron beam in a bundle to be scanned over a screen, and has: a field emission device including a plurality of electron emission zones arranged two-dimensionally, each of which being driven independently of the other electron emission zones, and emits an electron beam by means of an electric field; and an electron lens accelerating and converging the electron beam bundle.

In the field emission device of this electron gun, a plurality of electron emission zones are provided two-dimensionally, each of which is driven independently. Therefore, the sectional form of the electron beam bundle at the time of emission is changed in all directions of the screen including a horizontal direction (i.e. a scanning direction of the electron beam bundle).

Here, the aforementioned electron emission zones disposed two-dimensionally are able to emit an electron beam independently of each other, and correspond to the three electron emission zones depicted in FIG. 15.

Here, it is desirable that the aforementioned electron gun has a detection unit that detects distortion of a spot profile of the electron beam bundle emitted from the emitters, and that its electron lens includes a rotation unit operable to rotate the electron beam bundle around an axis that coincides with the direction of the electron beam bundle, so as to correct the distortion based on the detection result of the detection unit.

Such electron gun whose electron lens includes a rotation unit is able to emit an electron beam bundle whose spot profile on the screen will be less distorted even on the corner of the screen, than an electron gun without such a rotation unit.

Furthermore, in the electron gun of the present invention, at least one of the field emission device and the electron lens is preferably equipped with a deferential exhausting unit made of a getter material, with a view to maintaining a good electron emission performance. Therefore, in the electron gun having the stated construction, even if it is equipped with a field emission device with a high current density, its electron emission performance will not decrease throughout the operation.

In addition, a cathode ray tube apparatus of the present invention is characterized by including: a field emission device where a plurality of electron emission zones are arranged two-dimensionally, each electron emission zone emitting, by means of an electric field, an electron beam independently of the other electron emission zones; an electron lens accelerating and converging electron beams emitted in a bundle; and a deflection yoke deflecting the electron beam bundle before the electron beam bundle is scanned over a screen which is placed to oppose the deflection yoke.

In the stated cathode ray tube apparatus, the field emission device has a plurality of electron emission zones that are provided two-dimensionally, each of which is driven independently of the other electron emission zones. Therefore, the sectional form of the electron beam bundle at the time of emission is changed in all directions of the screen including a horizontal direction (i.e. a scanning direction of the electron beam bundle).

Furthermore, in the aforementioned cathode ray tube apparatus, it becomes possible to correct the sectional form of an electron beam bundle at the time of emission, according to the distortion generated at the electron beam bundle by the deflection yoke. This enables to optimally correct the distortion of the spot profile of the electron beam bundle on the screen, throughout the surface of the screen.

Therefore, the cathode ray tube apparatus of the present invention is capable of emitting an electron beam bundle having little distortion in form on the screen, regardless of an area of the screen irradiated with the electron beam bundle.

Here, the plurality of electron emission zones, just as mentioned above, are able to emit an electron beam independently of each other, and correspond to the three electron emission zones depicted in FIG. 15.

Furthermore, in the present invention, a method of producing a cathode ray tube includes: a storing step of storing an electron gun in a neck part of a funnel, the field emission device being included in the electron gun and emitting an electron beam bundle by means of an electric field; a connecting step of connecting the funnel to a panel; and an aging step of degassing a space formed between the funnel and the panel, where the field emission device has a plurality of electron emission zones arranged two-dimensionally, each of which emitting, by means of an electric field, an electron beam independently of the other electron emission zones, and the aging step is performed by generating ion by making electron emission zones positioning in an edge of the field emission device emit electron beams, and making the electron emission zones from which the electron beams are emitted absorb the generated ion.

In the aforementioned method of producing the cathode ray tube, during the degassing aging process, the degree of vacuum is improved within the cathode ray tube, in particular in the vicinity of the field emission device.

In addition, according to the production method of the present invention, the generated ion is absorbed by the electron emission zones positioning at the edges of the device, thereby preventing the reduction of luminance at the time of driving the cathode ray tube produced using the method.

Therefore, in the cathode ray tube produced using this method, the electron emission performance of a field emission device will not decrease much during the operation.

BEST MODE FOR CARRYING OUT THE INVENTION (The First Embodiment)

Figure 1:
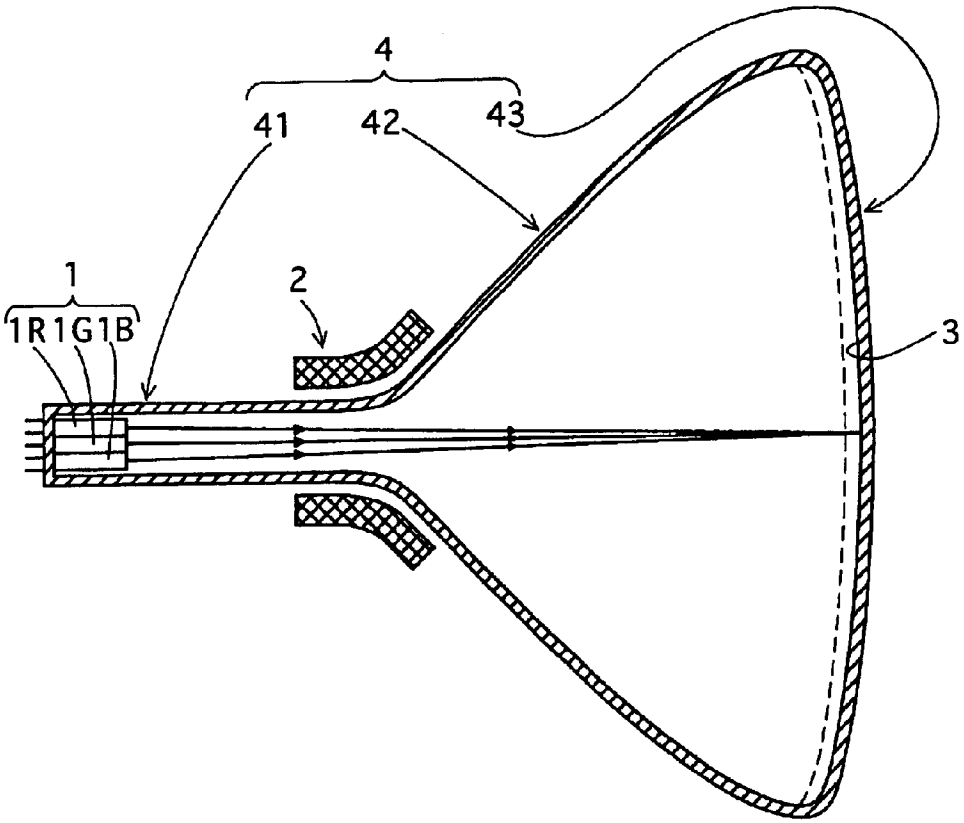
FIG. 1 is a diagram showing the construction of the CRT relating to the first embodiment.

A CRT according to the first embodiment of the present invention is depicted in FIG. 1.

The CRT of the present embodiment includes an electron gun 1 inside the neck 41 of the glass tube 4.

In addition, the CRT includes a deflection yoke 2 around an outer surface of the part connecting the neck 41 to a funnel 42. This deflection yoke 2 is comprised of a horizontal deflection coil that emits a horizontal deflection magnetic field, and a vertical deflection coil that emits a vertical deflection magnetic field.

The electron gun 1 emits an electron beam bundle according to an inputted signal. The emitted electron beam bundle is deflected by the deflection yoke 2, and then impinges on a phosphor layer formed on an inner surface of a screen 3 of a panel 43, thereby displaying an image.

The electron gun 1 includes three electron guns: an electron gun for red (R-electron gun 1R); an electron gun for green (G-electron gun 1G); and an electron gun for blue (B-electron gun 1B). This electron gun 1 is composed of three electron guns that are disposed in an in-line configuration.

Figure 2:
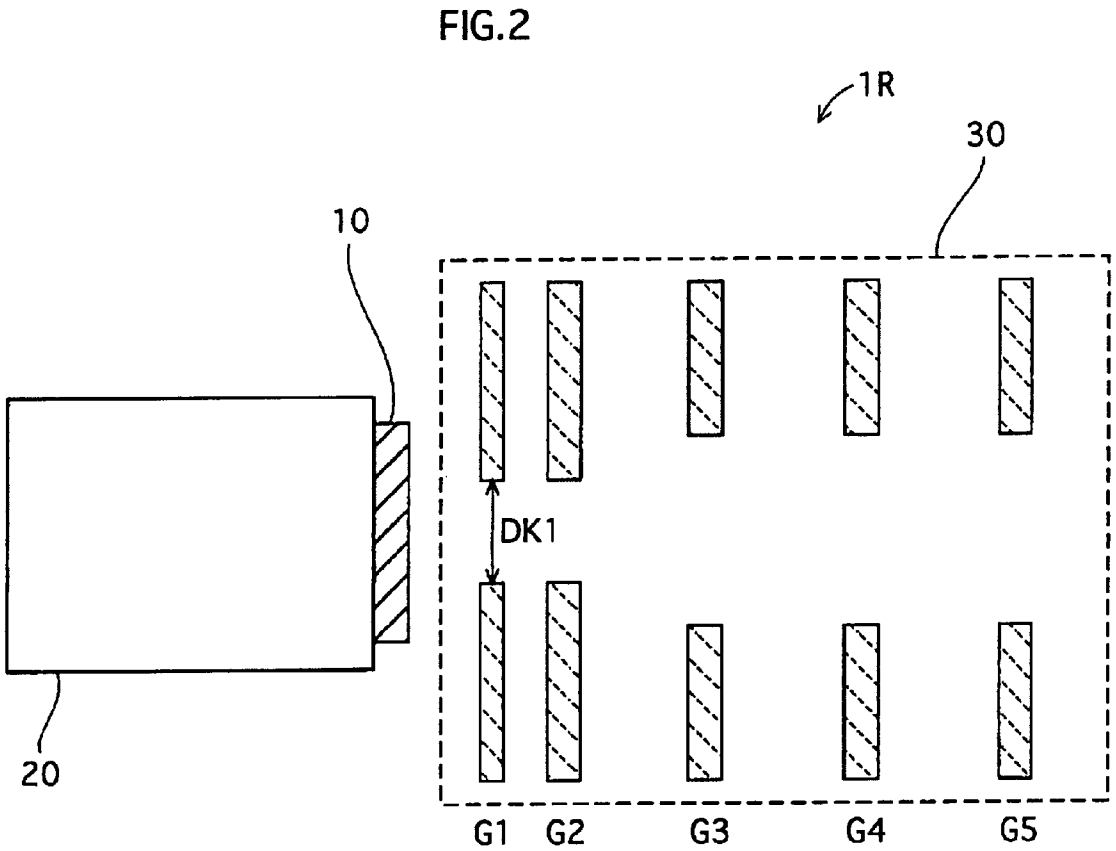
FIG. 2 is a diagram showing the construction of the electron gun depicted in FIG. 1.

The structure of the electron gun 1 is described taking the R-electron gun 1R as an example, with reference to FIG. 2.

As shown in FIG. 2, the R-electron gun 1R includes a field emission device 10, a cathode structure 20 on which the field emission device 10 is based, and an electron lens 30 that is a collection of grid electrodes G1–G5.

The electron lens 30 performs acceleration and convergence for an electron beam bundle, by the application of voltage to each grid electrode G1–G5. An opening is provided through the grid electrodes G1–G5, so that an electron beam bundle emitted from the field emission device can pass through the opening.

Figure 3:
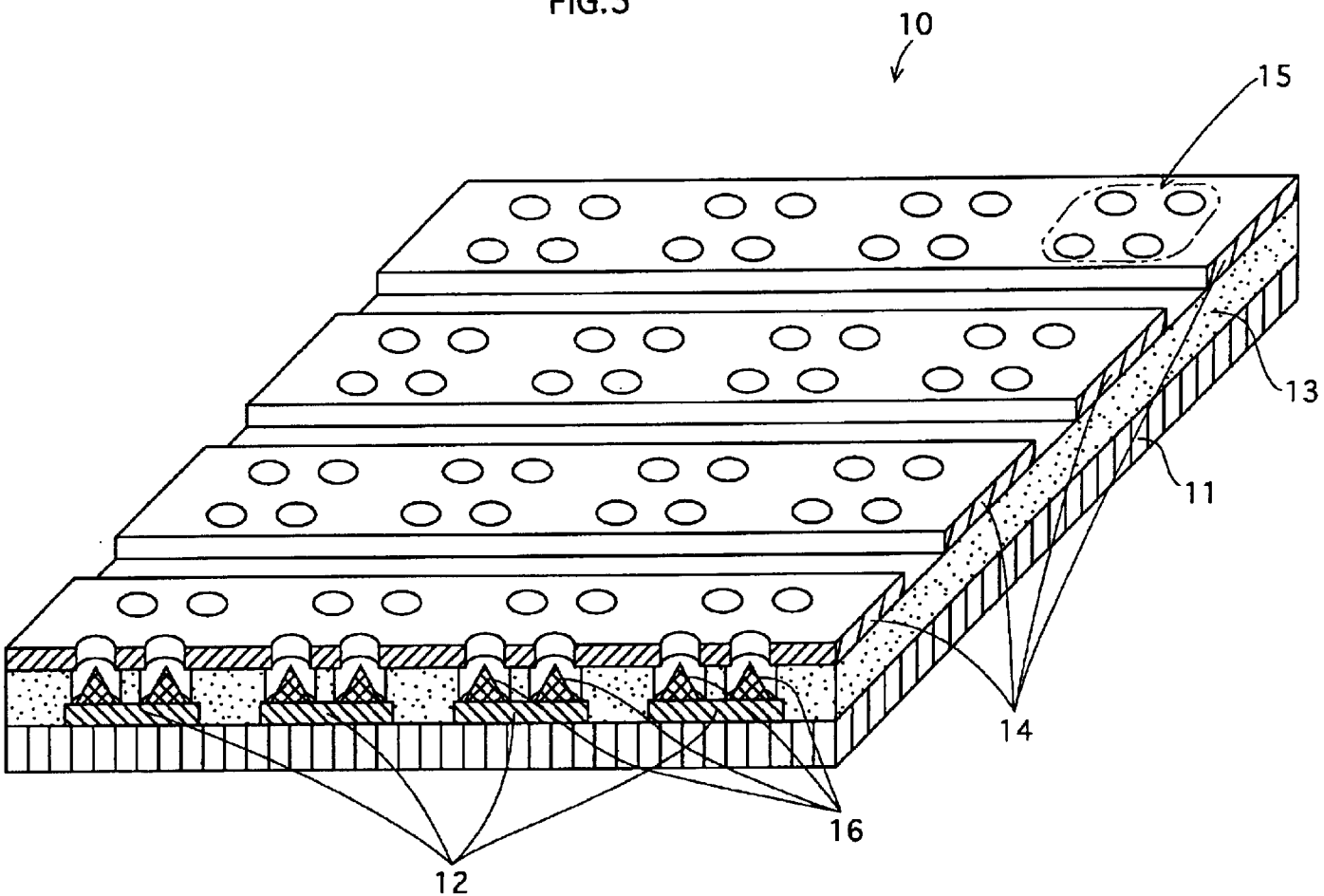
FIG. 3 is a perspective view of a part of the field emission device included in the electron gun of FIG. 2.

The structure of the field emission device 10 is explained with reference to FIG. 3. FIG. 3 only shows a part of the field emission device, for the sake of convenience.

As FIG. 3 shows, the field emission device 12 comprises four cathode electrodes 12 placed parallel to each other on a surface (upper surface in FIG. 3) of a substrate 11 made of glass. On the surface of each cathode electrode 12, emitters 16 in a cone-form are provided, and an insulation layer 13 is formed between the emitters 16 so that the insulation layer 13 embraces each emitter 16. The insulation layer 13 is also formed between the cathode electrodes 12 to embrace each cathode electrode 12.

The emitters 16 are a Spindt-type emitter that is obtained by evaporating molybdenum in a cone form, by a vacuum evaporation method for example.

Four extraction electrodes 14 are placed, on the insulation layer 13, to be parallel to each other, and to be orthogonal to the cathode electrodes 12. At each point of the extraction electrodes 14 where it crosses over the cathode electrodes 12 (crossover region), four openings are provided, each of which is placed above one emitter 16.

The field emission device relating to the present embodiment has a plurality of electron emission zones 15 disposed in a matrix form, each electron emission zone 15 being made up of four emitters 16 formed at each crossover region.

The number of emitters formed is four in FIG. 3, but is not limited to such, if the number falls within a range so that an emission density of the electron beam bundle is assured.

The electron gun 1 includes three field emission devices 10 having the stated structure that each correspond to R, G, and B, for the respective three electron guns for R, G, B.

Preferably, the diameter Dk1 for the opening at the grid electrode G1 of the electron lens 30 is set such that the relation shown by the following expression is satisfied.

<Expression 1>

$$Pm<(1/5)\times Dk1 \quad \text{(expression 1)}$$

Here, Pm represents a cycle of the cathode electrode 12 and the extraction electrode 14 at the field emission device 10, namely a matrix cycle.

The driving circuit for the CRT structured as above is described with reference to FIG. 4.

Figure 4:
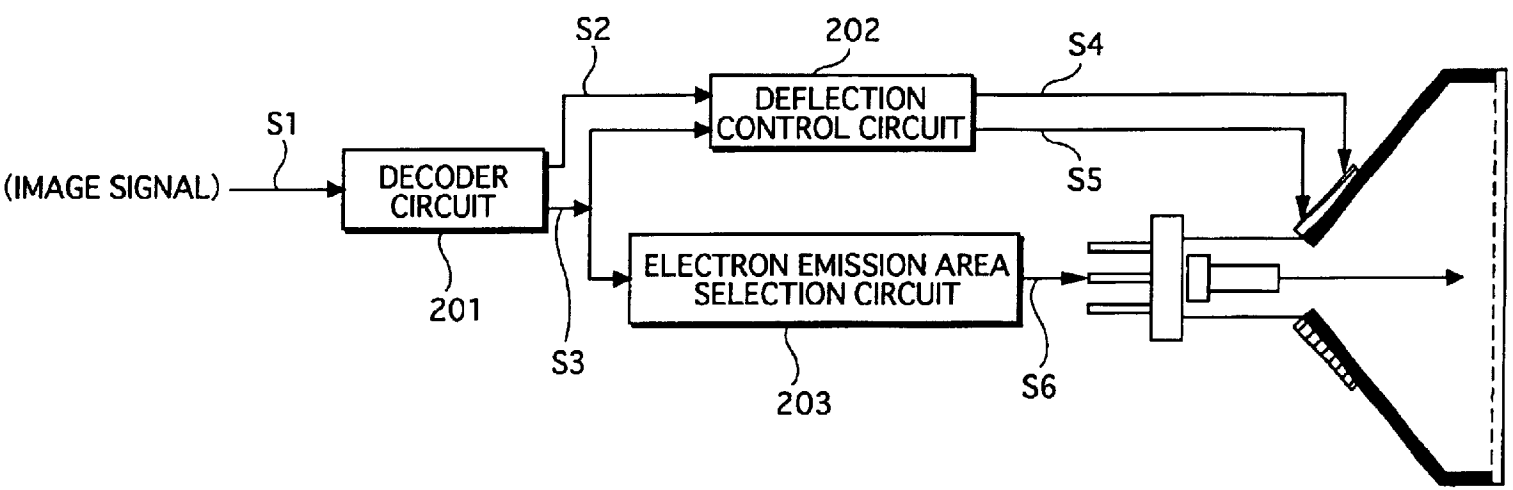
FIG. 4 is a block diagram showing the image display circuit included in the cathode ray tube of FIG. 1.

As shown by FIG. 4, in the CRT relating to the present embodiment, an image signal S1 is inputted to a decoder circuit 201. The decoder circuit 201 divides the image signal S1 into a vertical signal S2 and a horizontal signal S3.

The vertical signal S2 is exclusively inputted to the deflection control circuit 202.

Meanwhile, the horizontal signal S3 is inputted to both of the deflection control circuit 202 and the electron emission area selection circuit 203.

The deflection control circuit 202 transmits a vertical deflection signal S4 to the vertical deflection coil, and a horizontal deflection signal S5 to the horizontal deflection coil, both coils being at the deflection yoke 2.

The electron emission area selection circuit 203 selects, based on the inputted horizontal signal S3, an electron emission area detailed later, and transmits a signal S6 to the electron gun 1.

In addition to selecting an electron emission area, the electron emission area selection circuit 203 adjusts the voltage to be applied between the cathode electrode 12 and the extraction electrode 14 according to the inputted image signal. This will control the amount of electrons to be emitted from the electron emission area, thereby changing luminance of the screen 3.

At the CRT equipped with the aforementioned driving circuit, the sectional form of an electron beam bundle emitted from the electron gun 1 will change according to the area irradiated with the electron beam bundle, in synchronization with the horizontal deflection signal S5. This will be detailed later.

Next, an area division at the screen 3 that is performed at the time of driving the CRT is described with reference to FIG. 5.

Figure 5:
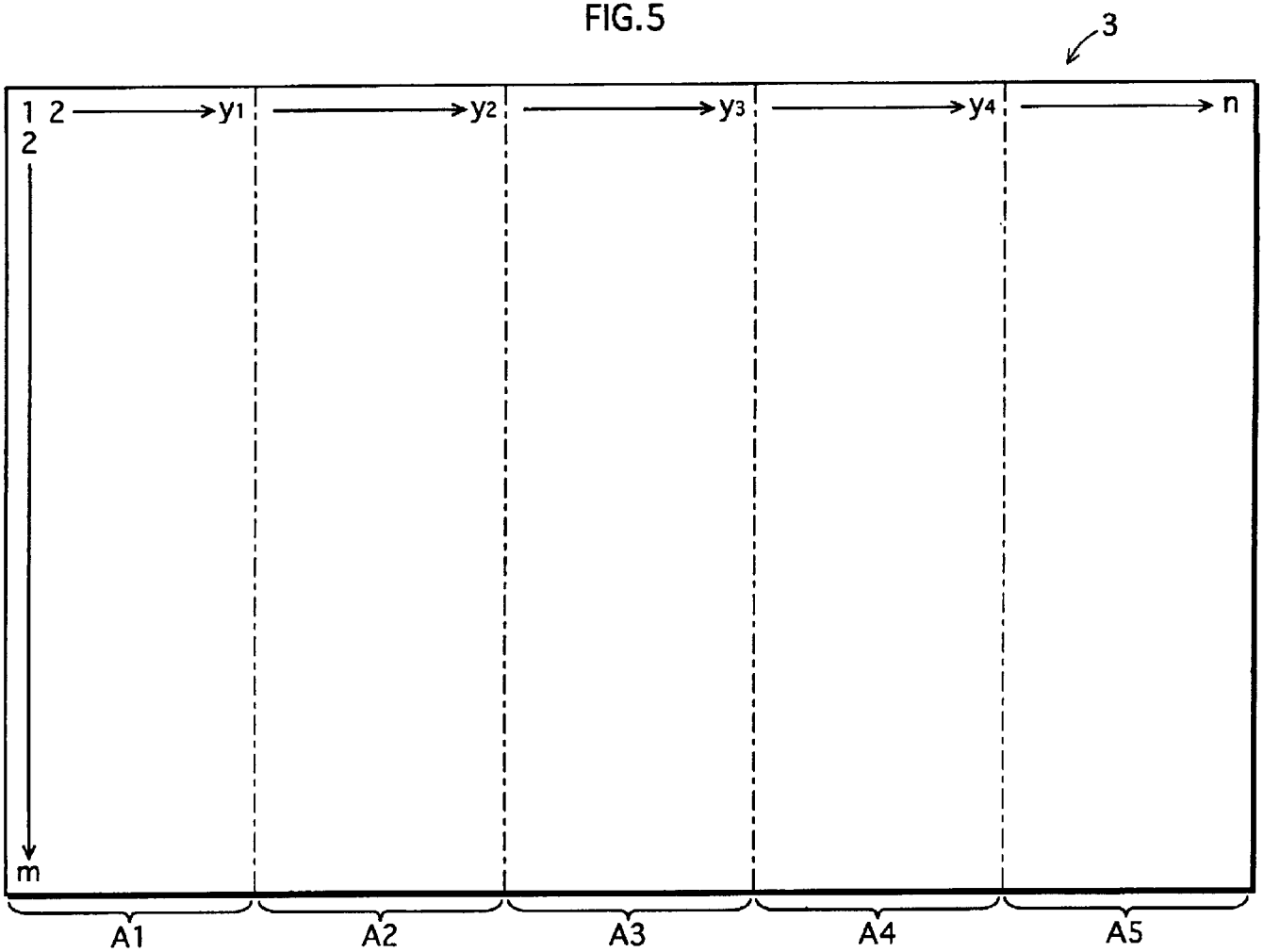
FIG. 5 is a plan view of the screen in the CRT of FIG. 1.

FIG. 5 is an illustration in which the screen 3 of FIG. 1 is conceptually divided into areas A1, A2, A3, A4, and A5 aligned in a horizontal direction from left to right, when looked at from the above.

Here, the screen 3 has a pixel m×n (row, column). The emitted electron beam bundle is scanned on the screen 3.

As shown in FIG. 5, the area A1 is an area 1–y1 in the column direction. Likewise, the areas A2, A3, A4, and A5 are respectively (y1+1)–y2, (y2+1)–y3, (y3+1)–y4, and (y4+1)–n, in the column direction.

In the CRT relating to the present embodiment, an electron emission area is selected from the field emission device 10, depending on an area of the screen 3 to be irradiated, and the electron beam bundle of a desired form will be emitted.

As mentioned earlier, the selection of an electron emission area is performed according to a horizontal signal S3. To be specific, the electron emission area selection circuit 203 prestores a table in which areas of the screen to be irradiated are respectively corresponded to electron emission areas, and the selection of an electron emission area corresponding to the horizontal signal S3 is performed with reference to this table.

The method of selecting electron emission areas is described with reference to FIGS. 6A, 6B, and FIG. 7. FIGS.

Figure 7:
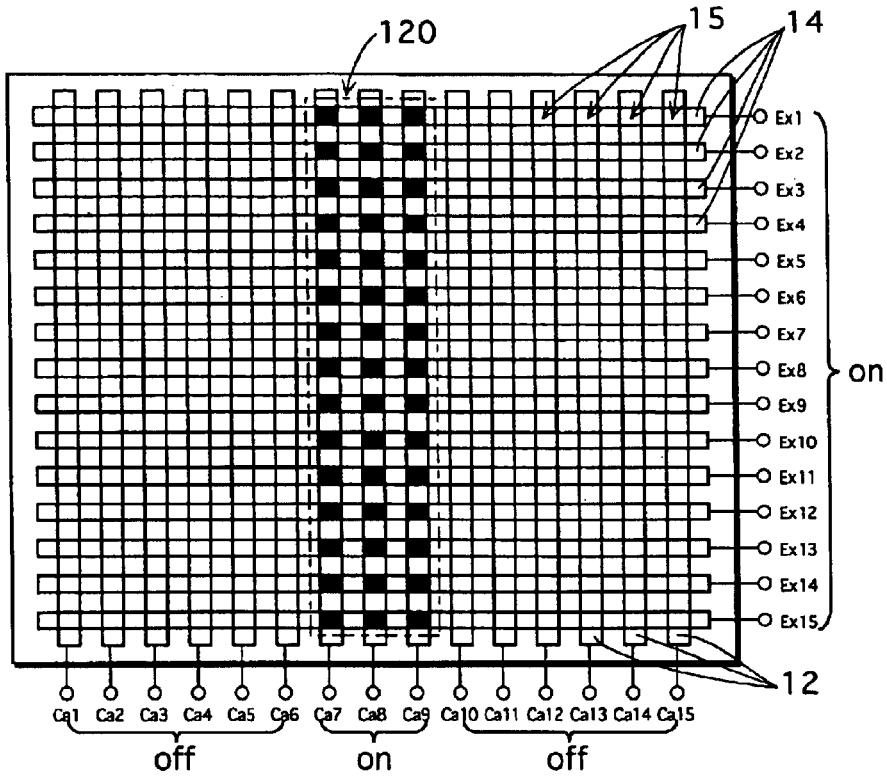
FIG. 7 relates to the first embodiment and is a plan view of the electron emission area included in the field emission device.

6A, 6B, and FIG. 7 are plan view of the aforementioned field emission device of FIG. 3, when it is seen from the above.

As shown in these figures, the field emission device 10 is equipped with fifteen cathode electrodes 12 in a row direction, and fifteen extraction electrodes 14 in a column direction. As mentioned earlier, the electron emission zones 15 are formed at the crossover regions between cathode electrodes 12 and extraction electrodes 14. Each electron emission zone 15, although not shown by the figures, is composed of four emitters, just as in FIG. 3 mentioned earlier.

With this CRT, an electron emission area (rectangular in shape) can be arbitrarily set as for each of its length and width, and its position as well, by the selection of on/off for each cathode electrode Ca1–Ca15, and that for each extraction electrode Ex1–Ex15.

Figure 6A:
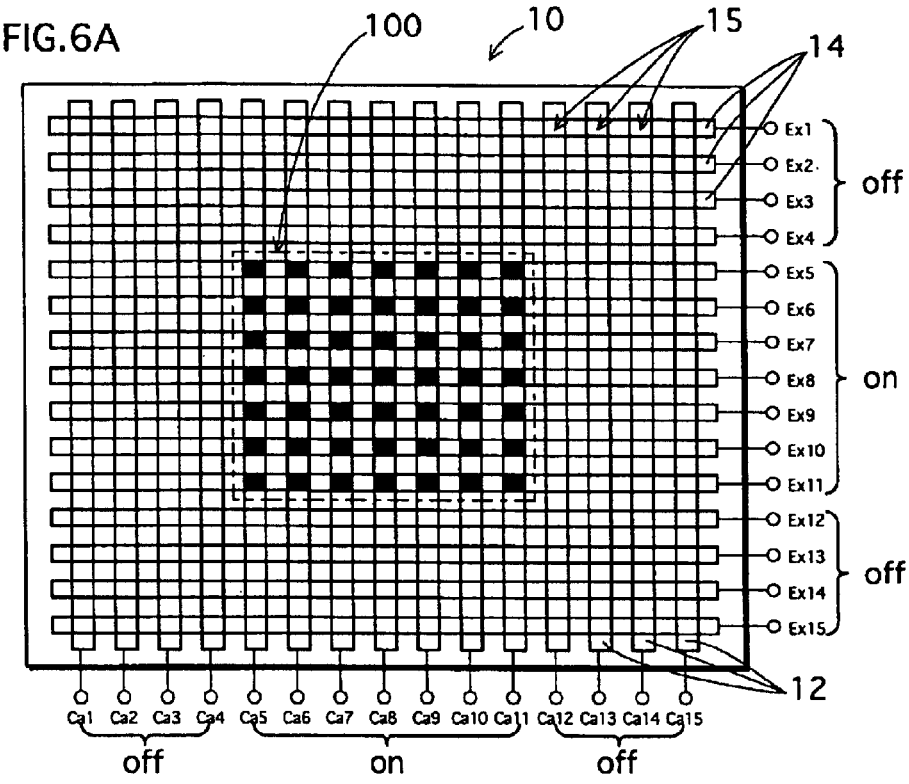
FIGS. 6A and 6B relate to the first embodiment and are each a plan view of the electron emission areas included in the field emission device.

In FIG. 6A, the electron emission area 100 of the field emission device 10 is described, from which an electron beam bundle is directed towards the area A3 of FIG. 5.

As shown in FIG. 6A, in the field emission device 10, a voltage exceeding the threshold value is applied between the electrodes Ca5–Ca11 among the cathode electrodes 12, and between the electrodes Ex5–Ex11 among the extraction electrodes 14. The voltage is 60 (V) for example. By doing so, the electron emission area 100 is set to have 7×7 (row, column) electron emission zones 15 positioning at the center of the field emission device 10. That is, the aforementioned electron emission area selection circuit 203 recognizes which area out of the screen 3 should be irradiated with the electron beam bundle, according to the inputted horizontal signal S3, and selects electrodes to apply voltage on, from each of the fifteen cathode electrodes 12 and fifteen extraction electrodes 14. Then, the electron emission area selection circuit 203 applies voltage exceeding the threshold value to the selected electrodes (i.e. Ca5–Ca11, and Ex5–Ex11), so as to emit an electron beam bundle.

Note that in this embodiment, voltage will not be applied to the cathode electrodes Ca1–Ca4, Ca12–Ca15, or to the extraction electrodes 14, Ex1–Ex4, Ex12–Ex15.

Figure 6B:
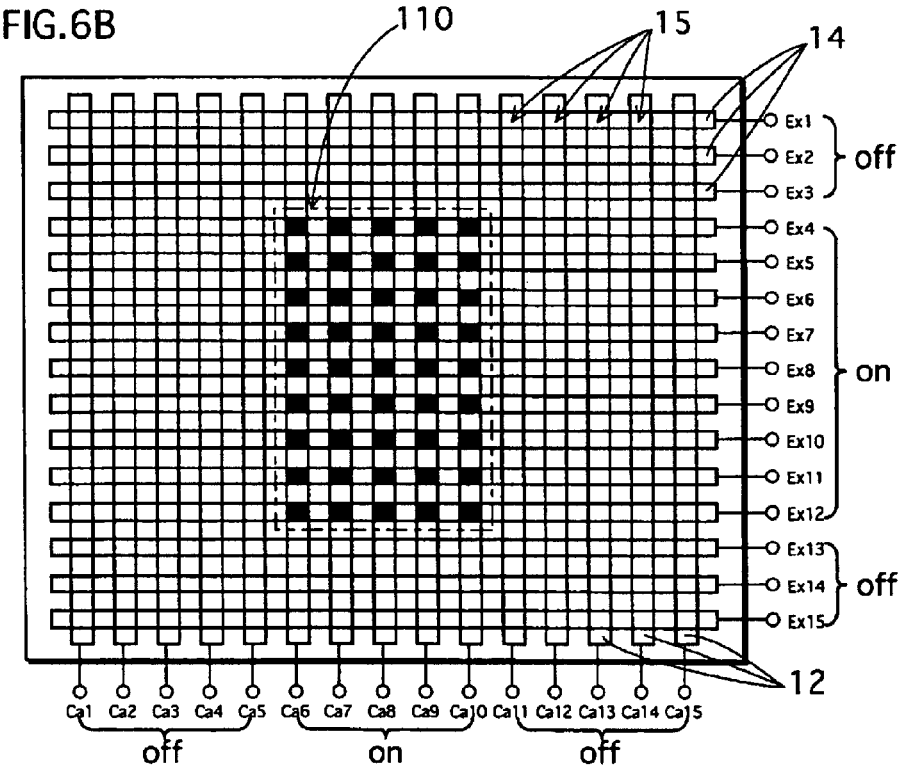

In FIG. 6B, the electron emission area 110 of the field emission device 10 is described, from which an electron beam bundle is emitted towards the areas A2 and A4 of FIG. 5.

As shown in FIG. 6B, the electron emission area 110 is set to fall within 9×5 (row, column), which is narrow in the horizontal direction. By the aforementioned arrangement in which the width of the electron emission area 110 is set to be narrower than that of the aforementioned electron emission area 100 depicted in FIG. 6A, correction is made possible against the deformation in the form of electron beam bundles, caused by the deflection magnetic field generated by the deflection yoke 2. That is, when emitted from the electron emission area 110, the electron beam bundle impinged on the areas A2 and A4 will yield a spot profile having substantially the same horizontal length as that on the area A3. As described above, this is realized in this CRT, by the electron beam bundle emitted in a vertically long form from a source, so as to counteractively correct the spot profile of the electron beam bundle, which would be otherwise horizontally long on the areas A2 and A4 irradiated therewith.

The reason why the number of rows in the electron emission area 110 of FIG. 6B is larger by two than that in the electron emission area 100 of FIG. 6A is for making the sizes of the stated areas substantially the same. That is, in the CRT according to the present embodiment, the luminance is maintained by making the area 100 and the area 110 have substantially the same size. In this case, the spot profile will be vertically longer in FIG. 6B than in FIG. 6A. Generally speaking, however, a vertically long spot profile will hardly affect the effective resolution.

Further, as shown in FIG. 7, the electron beam bundle directed to the areas A1 and A5, both positioning on the edge parts of the screen 3, is to be emitted from an electron emission area 120 of 15×3(row, column), which has a rectangular form having a width narrower than the aforementioned FIG. 6B. In this case, it becomes possible to correct the distortion in the electron beam bundle at the edge of the screen, by the arrangement in which the electron emission area 120 is made to be still narrower in width than the electron emission area 110.

At the electron emission area 120, the number of rows is set to be about twice as much as that of the electron emission area 100. However, this will not affect the effective resolution, as mentioned earlier.

The CRT relating to the present embodiment, as seen in the above, is able to produce an excellent resolution by optimally correcting the distortion of electron beam bundles, which results from the deflection magnetic field generated by the deflection yoke 2.

In addition, with the stated field emission device 10, any of the electron emission areas 100, 110, and 120 has larger potential difference between the cathode electrodes 12 and the extraction electrodes 14 than different area, to enable the device itself to converge the electron beam bundles.

Note here that, in the field emission device 10, the electron emission zones 15 are placed in a matrix configuration. It should be noted, however, that the configuration and the like for the electron emission zone 15 are not limited to the above.

In addition, the numbers of the cathode electrodes 12, the extraction electrodes 14, and the emitters 16 are not limited to as depicted in the aforementioned FIG. 3, as long as the correction against the distortion in spot profile of the electron beam bundles can be performed. However, the electron emission zones 15 are required to be disposed two-dimensionally, so as to correct distortions.

Furthermore, in the present embodiment, driving of the electron emission zone 15 is controlled by means of the cathode electrodes 12 and the extraction electrodes 14 disposed in a matrix configuration. Therefore, in selecting electron emission zones 15 consecutively, the form thereof is made to be rectangular. However, the form of the area from which electron beam bundles are emitted is not limited to rectangular. For instance, the present embodiment may emit electron beam bundles in arbitrary forms such as circular or oval, by controlling the electron beam bundle according to each electron emission zone 15.

(The Second Embodiment)

The second-embodiment of the present invention is described as follows, with reference to FIGS. 8A and 8B. The structure of the CRT according to the present embodiment is the same as that in the first embodiment.

Figure 8A:
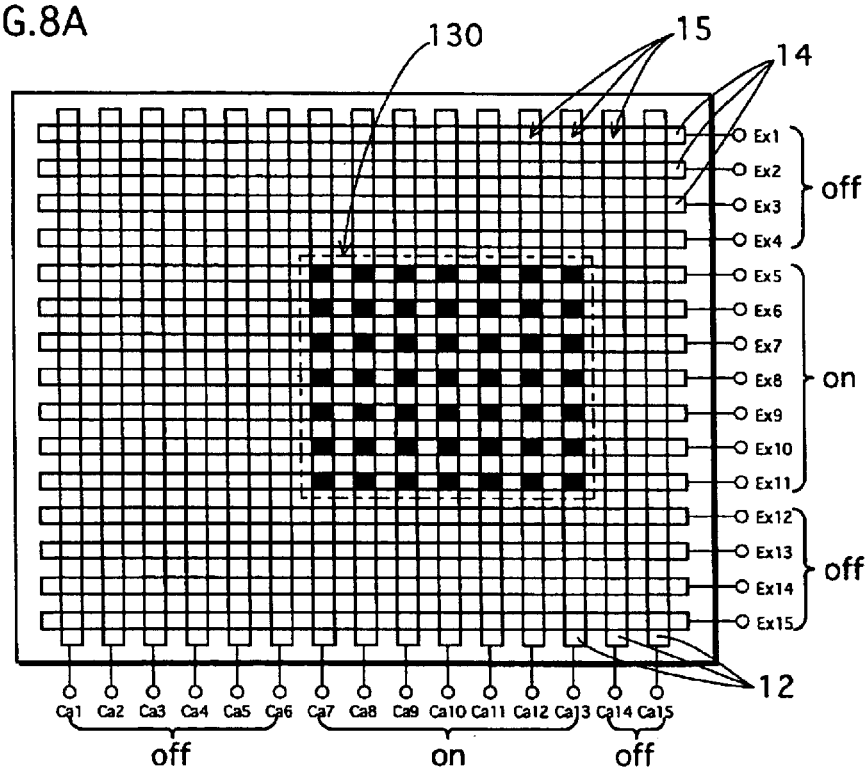
FIGS. 8A and 8B relate to the second embodiment and are each a plan view of the electron emission area included in the field emission device.

As shown in FIG. 8A, the electron emission area 130 is identical to the aforementioned electron emission area 100, in terms of the number of rows and columns making up the area, except that the electron emission area 130 is shifted to the rightward direction, when looked at from above. This means that the electron beam bundle is identical, in form, to the one depicted in FIG. 6A.

The correction in position of an electron beam bundle is performed in a case where the field emission device 10 and the electron lens 30 are horizontally misaligned, in response to a feedback from a misalignment-detection circuit on how much misalignment has occurred.

Generally, in a CRT, it happens that an electron beam bundle emitted from the electron gun will change in orbit before reaching the screen, due to an external magnetism such as the terrestrial magnetism, thereby shifting the position of the electron beam bundle on the screen. In order to restrain, to a minimum, such deviation of orbit resulting from an influence of the terrestrial magnetism, a mechanical mask is provided so as to protect the CRT from the influence of the external magnetism.

However, even such mechanical mask sometimes cannot work as enough protection against the external magnetism depending on the location (region) of the CRT, thereby causing a deviation in position of electron beam bundles on the screen.

In order to tackle this problem, in the CRT according to the present embodiment, its electron emission area selection circuit 203 prestores information on the terrestrial influence in the region in which the CRT will be placed (e.g. country information). Based on this table, the electron emission area selection circuit 203 selects an area from which an electron beam bundle is emitted, thereby correcting the position of the electron beam bundle on the screen. Specifically, the correction in position of the electron beam bundle is performed as follows.

First, at the time of activating the CRT, the electron emission area selection circuit 203 at the CRT recognizes the place in which the CRT is installed (e.g. country information) by means of the terrestrial magnetism sensor that is incorporated therein. An example of the terrestrial magnetism sensor is a flux-gate sensor.

Next, the electron emission area selection circuit 203, having recognized the place in which the CRT is installed, selects an electron emission area, by referring to the table in which the effect of the terrestrial magnetism is associated with an electron emission area for each region.

As in the above, the CRT according to the present embodiment is able to maintain high-resolution performance, without depending on the place where the CRT is installed.

Note here, that in the aforementioned CRT, recognition of the place of installation was performed with use of the terrestrial magnetism sensor. However, the recognition of the place of installation can be performed by a different means. For example, it is possible to adopt a method prompting the user of the CRT to input information on the place of installation, and the CRT performs correction for the position of electron beam bundles based on this information. Such CRT will be excellent from a cost point of view, since it enables simpler apparatus structure for performing position correction.

In addition, the position correction performed by the CRT described in the present embodiment is only directed to the electron beam bundles that are deviated in the horizontal direction. However, electron beam bundles can be also corrected in a vertical direction.

This vertical correction is realized by making the decoder circuit 201 input the vertical signal S2, in addition to the horizontal signal S3, to the electron emission area selection circuit 203.

In addition, generally, the electron emission performance will deteriorate as the device is driven over a long period of time. However, with the CRT of the present embodiment, the reduction in luminance will be restrained, as explained in the following, by increasing the size of the electron emission area.

The reduction in luminance is restrained by making the aforementioned electron emission area selection circuit 203 prestore a table in which corresponded are lengths of time for which the device has been driven (driving time) and electron emission areas of the device, and by selecting an electron emission area with reference to this table.

Figure 8B:
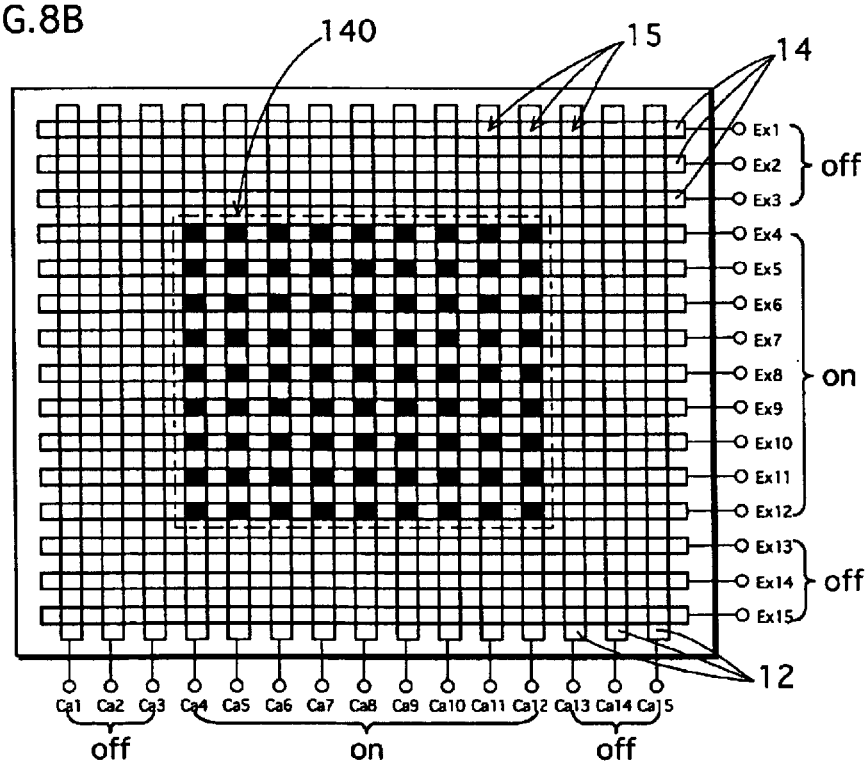

More specifically, at a time when the driving time exceeds the length of time initially set, the electron emission area 140 shown in FIG. 8B will be designated to emit electron beam bundles. Because the size of the electron emission area 140 is designed to be 65% larger than that of the electron emission area 100, the reduction in luminance at the CRT will be adequately restrained.

As such, in the CRT relating to the present embodiment, even when the electron emission performance is deteriorated after the device has been driven over a long period of time, it is possible to restrain the reduction in luminance by increasing the size of the electron emission area. That is, in this CRT, it becomes possible to restrain the reduction in luminance, without increasing the emission current that works as a disadvantage against the lifespan of the emitter 16.

Note that also in this embodiment as well as in the first embodiment, the form of the electron emission zone 15, and the numbers of the cathode electrodes 12, of the extraction electrodes 14, and of the emitters 16, are not limited to as described earlier.

In addition, the switching between the electron-emission areas having different sizes may be performed according to the driving time as described. However, the switching may be also performed according to a result of measuring the luminance at the screen 3.

Furthermore, the size control of the electron emission area may also be performed according to the luminance level specified by an input signal, as well as according to the deterioration level of the device.

In general, the luminance is changed according to each inputted image signal, by changing the voltage applied between the cathode electrodes 12 and the extraction electrodes 14. However, in the CRT of the present embodiment, the luminance is changed according to increase/decrease in size of the electron emission area, without changing voltage to be applied.

In this case, luminance will be changed by making the electron emission area selection circuit 203 prestore a table in which image signals and the electron emission areas are corresponded, and by selecting an electron emission area at the time of driving, with reference to this table and the image signal.

(The Third Embodiment)

Figure 9:
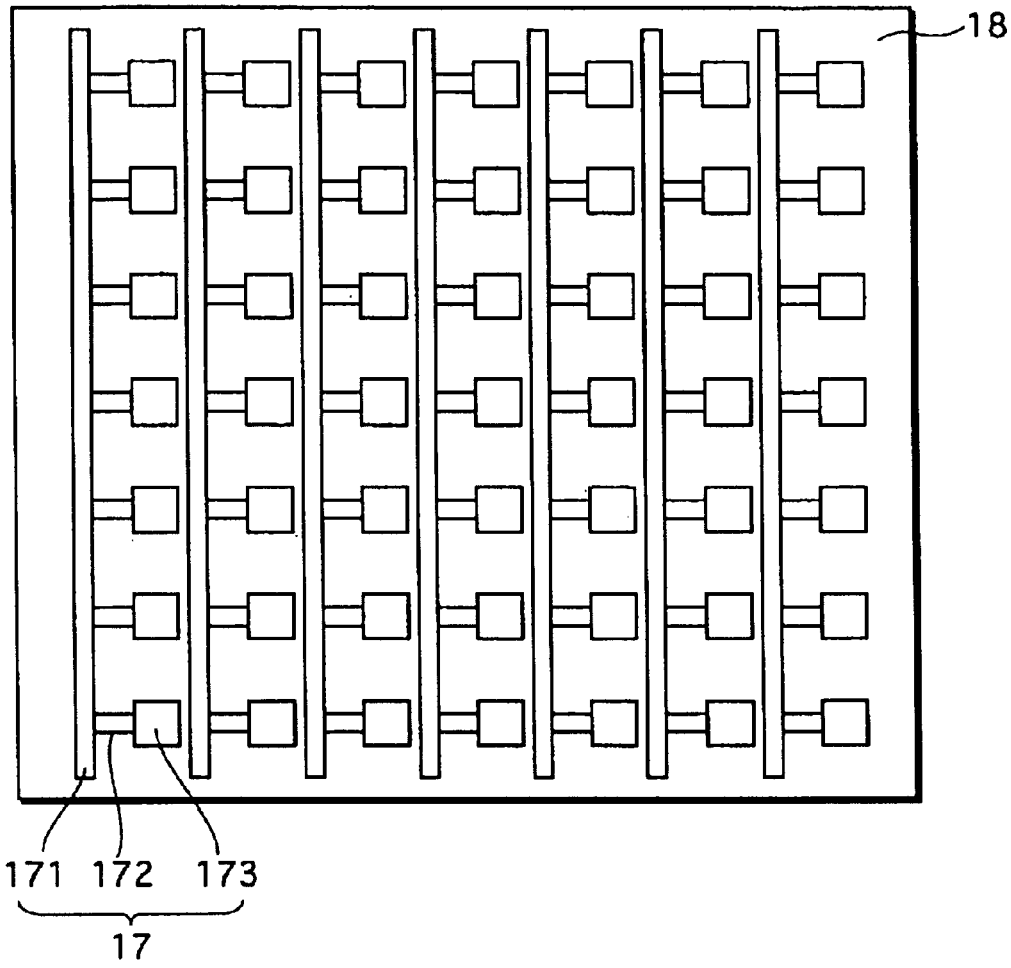
FIG. 9 is a plan view showing the structure of the cathode electrode included in the field emission device, which is included in the CRT of the third embodiment.

The field emission device relating to the third embodiment is described as follows, with reference to FIG. 9. FIG. 9 is a diagram showing the manner in which cathode electrodes 17 are formed on a substrate 18 made of a p-type silicon material. Here, the extraction electrodes 14, the emitters 16, and the like are similarly structured as those in FIG. 3 mentioned earlier. However, the disposition of the emitters 16 is different in this embodiment, therefore will be explained in the following description.

As shown in FIG. 9, each cathode electrode 17 is made up of three parts, a common electrode part 171, an electric current control part 172, and an array part 173.

There are seven common electrode parts 171 provided parallel to each other. The common electrode parts 171 have n-type conductivity and have a low resistance conductive property. The common electrode parts 171 are formed, on a p-type silicon substrate 18, by ion implantation of an impurity element such as phosphor.

The electric current control parts 172 are formed so that each of them branches off from a common electrode part 171 at a constant interval therebetween. This electric current control part 172 has n-type conductivity just as the common electrode part 171, except that the electric current control part 172 has conductivity with high resistance.

The array parts 173, having n-type conductivity and a low-resistance conductive property, are formed so that each of them is connected to a different one of the electric current control parts 172. Although not shown in FIG. 9, emitters 16 that emit electrons are provided on the surface of array parts 173 in a protruding condition.

An electric current is fed to the emitter 16, via the common electrode part 171, the electric current control part 172, and the array part 173, in the stated order.

The properties that the above field emission device has at the time of driving are described with reference to FIG. 10.

Figure 10:
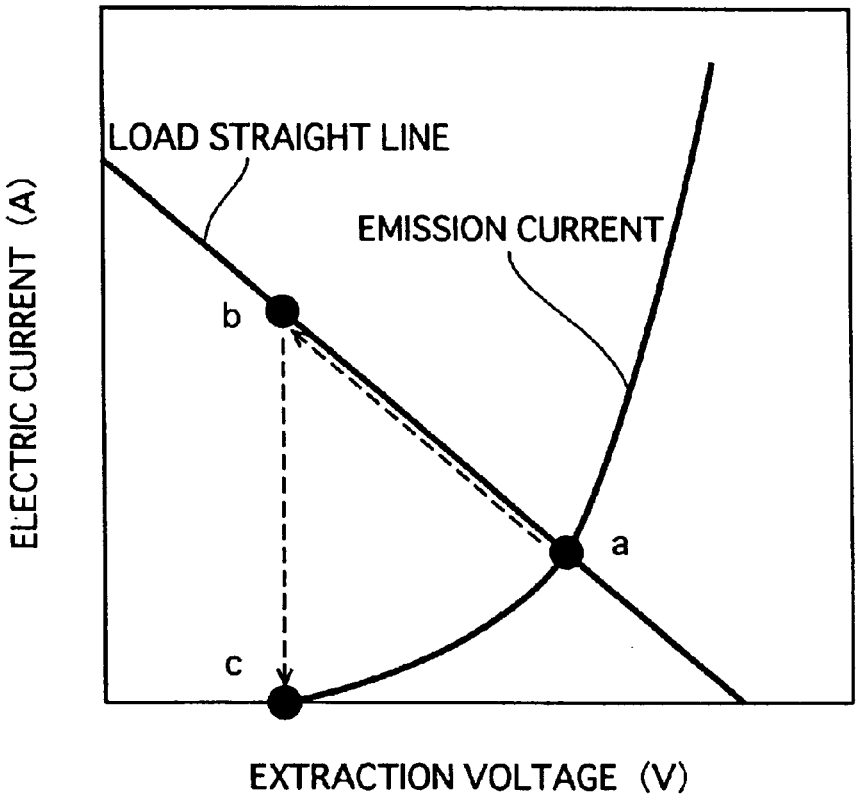
FIG. 10 is a plot in which the relation between extraction voltage and emission electric current is shown.

In FIG. 10 showing the properties, the curve represents a relation between a voltage applied between the extraction electrode 14 and the cathode electrode 17 (hereinafter "extraction voltage E") and the amount of electrons emitted from the emitter 16 (hereinafter "emission electric current I").

The straight line in the figure represents a relation between the applied voltage and the electric current at the electric current control part 172.

In a conventional field emission device without the electric current control unit 172 at its cathode electrode 12, when a leak electric current is generated such as due to a dust attachment at one part, an extraordinarily large electric current will run through the cathode electrode 12, which occasionally leads to a malfunction of the entire device.

In contrast, in the field emission device of the present invention, the malfunction of the entire device is prevented as described in the following.

In FIG. 10, as the field emission device of the present embodiment initially executing a normal emission operation shifts along the straight line from the point a to the point b due to an occurrence of leak, there will be a restriction on the increase in the emission electric current I, due to the load resistance of the electric current control part 172. Therefore, the device shifts to the point c, at which the emission of electron beam bundles from this electron emission zone 15 halts.

This means that the malfunction due to leaking will occur only at the particular electron emission zone 15 that is being suffered from the leak, and not in other electron emission zones 15. Therefore, according to this field emission device, when a leak occurred at some electron emission zones 15 such as due to a dust attachment, not the whole device will malfunction.

Note here, that the field emission device according to the present embodiment will produce an effect not only when used in a CRT, but also when used in a high intensity luminous display tube, or in a luminous display tube for illumination, both being used outdoors.

Furthermore, the structure of the field emission device is not limited to as described above. For example, the substrate 18 may be made of a glass material. In also such a case, the equivalent effect to as stated earlier will be produced.

(The Fourth Embodiment)

The structure of the CRT that relates to the fourth embodiment is described as follows with reference to FIG. 11.

Figure 11:
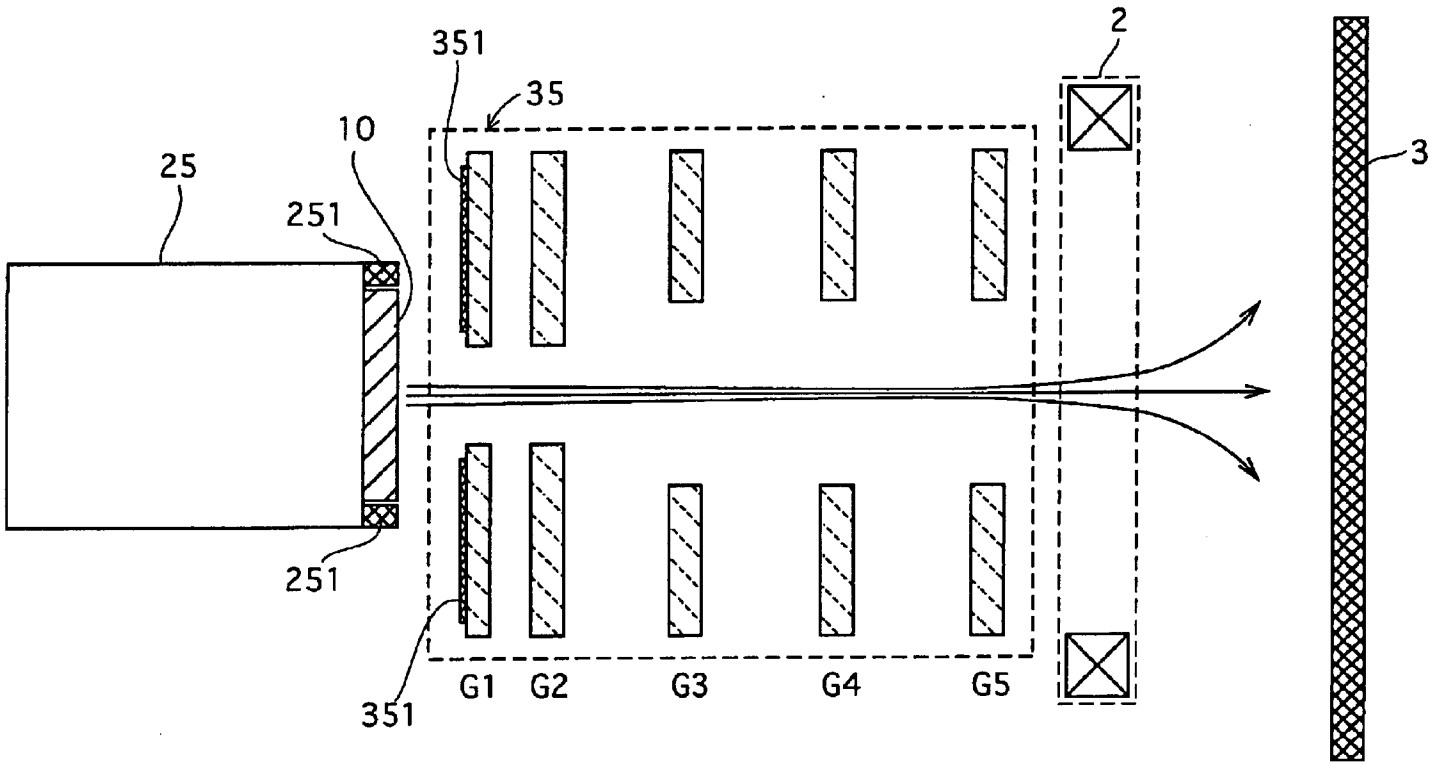
FIG. 11 is a diagram showing the structure of the CRT relating to the fourth embodiment.

As shown in FIG. 11, the structure of the CRT for the present embodiment is the same as those in the aforementioned FIG. 1 and FIG. 2. However, the present embodiment is different in that a gas absorptive member 251, 351 made of a frittable getter material are respectively formed on the surface of the cathode structure 25 and on the surface of the grid electrode G1 constituting the electron lens 35.

This frittable getter material is nonevaporation type, and is advantageous in terms of heat resistance and environmental resistance, compared to the evaporation type getter material widely used in producing conventional CRTs. The example of such frittable getter material includes an alloy material composed of zirconium (Zr), aluminum (Al), and titanium (Ti).

The gas absorptive members 251 and 351 are formed, by first applying the aforementioned alloy material on the surface of bases, namely on the surfaces of the cathode structure 25 and the grid electrode G1, and then subject the formed alloy material to heat processing (400° C.–500° C.) at the final stage of the production process. This final process for heating is for activating the getter material; therefore is performed using a high frequency heating method.

In the conventional CRT, a variety of gas generated in the production process will remain inside the glass tube, in spite of degassing. Such remaining gas will be altered to a large amount of ion, as a result of impingement with the electron beam bundle emitted from the electron gun. The generated ion will then come into collision with the emitters 16 of the field emission device 10, thereby causing to deteriorate the electron emission performance.

In contrast, in the CRT having the gas absorptive members 251, 351 inside the electron gun 1, the gas absorptive members 251, 351 will absorb a gas remaining inside the glass tube 4. This will restrain the generation of ion in the vicinity of the field emission device 10. In the present embodiment, the gas absorptive members 251, 351 are formed inside the electron gun 1. Accordingly, the effect of restraining the generation of ion is much greater than a conventional CRT in which an evaporation type getter material is formed on the surface of its electron gun.

Therefore, in the CRT of the present embodiment, there will be much less reduction in electron emission performance with an elapse of driving time, than in the conventional CRT.

Note here that in the electron gun relating to the present embodiment, the place where the gas absorptive member 351 is formed is not limited to a surface of the grid electrode G1, but may be on the surface of the other grid electrodes G2–G5. However, in view of enhancing the degree of vacuum in the vicinity of the field emission device 10, the gas absorptive member 351 should preferably be placed in the vicinity of the field emission device 10 inside the electron lens 35.

Furthermore, in the production stage of this CRT, the following will be performed after the degassing aging process in which a sufficient degassing has been performed using a conventional method. That is, an electron beam bundle is emitted from an area that normally does not emit an electron beam bundle (i.e. electron emission zones 15 positioning in the edges of the device 10). The emitters 16 near this area will absorb the generated ion. As such, the CRT relating to the present embodiment will not affect the emitters 16 in the electron emission zones (i.e. electron emission zones 15 positioning in the center of the device), thereby assuring an exceptionally high degree of vacuum.

The reason why the electron emission zones 15 positioning at the edges of the device are used for absorbing ion in the degassing aging process is because the edges of the device are rarely used, at the time of driving the CRT. Accordingly, the edges of the device will not have much influence on the luminance at the time of driving the device, when compared to the electron emission zones 15 positioning in the center of the device.

Therefore, with the CRT produced using such method, the electron emission performance of the field emission device 10 will not decrease at the time of driving the CRT, and stable luminance will be maintained regardless of the length of driving time.

(The Fifth Embodiment)

The structure of the electron gun relating to the fifth embodiment is described as follows with reference to FIG. 12.

Figure 12:
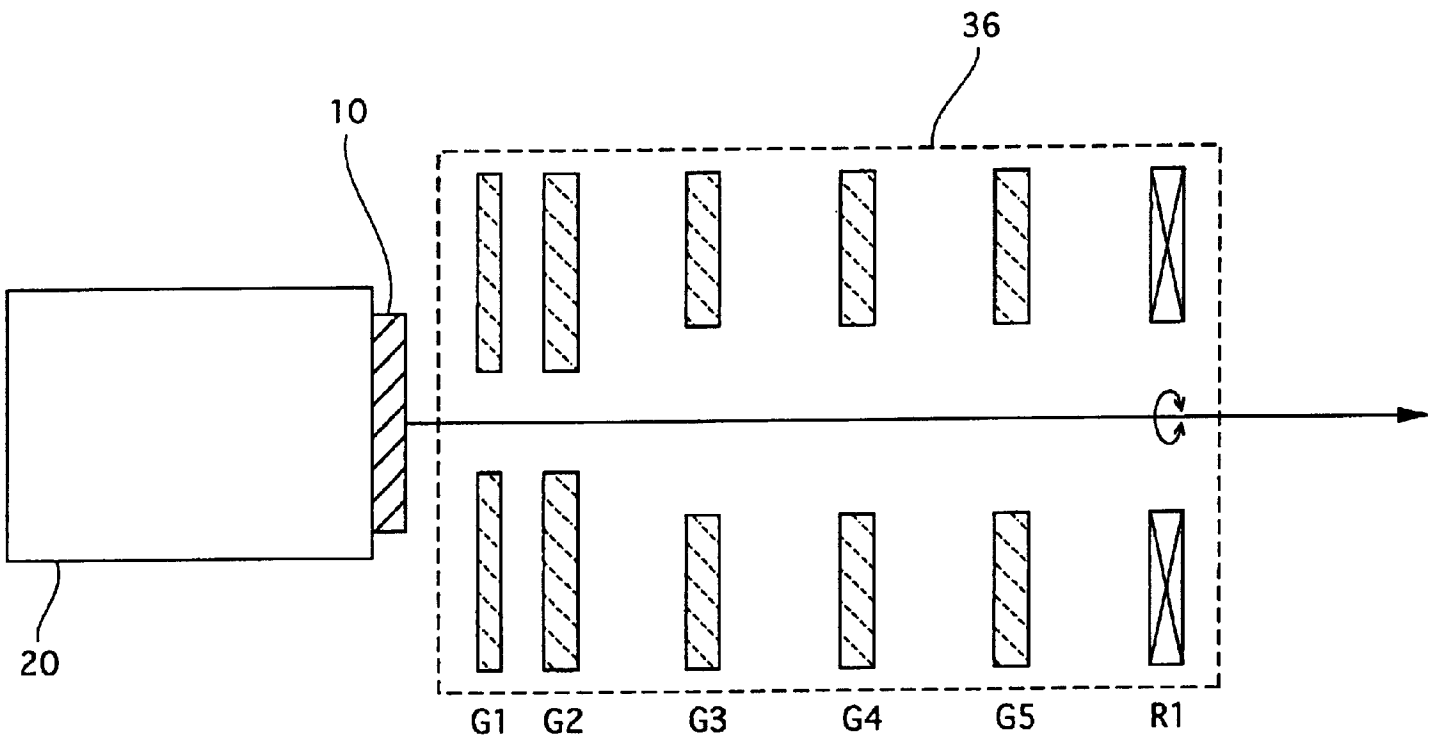
FIG. 12 is a diagram showing the structure of the electron gun relating to the fifth embodiment.

As shown in FIG. 12, the electron gun relating to the present embodiment is made up of a field emission device 10, a cathode structure 20, and an electron lens 36.

The field emission device 10 and the cathode structure 20 are structured in the identical manner as those in the aforementioned FIG. 3.

The electron gun of the present embodiment is different from the one in FIG. 2 in the structure of the electron lens 36. The electron lens 36 is composed of grid electrodes G1–G5, and a beam rotation coil R1.

The beam rotation coils R1 are each produced for the field emission devices for red, green, and blue, respectively. Each beam rotation coil is used to rotate the corresponding electron beam bundle by forming electric fields. One example of the beam rotation coil is a solenoid coil.

More specifically, a solenoid coil is prepared for each field emission device of the electron gun. Then, a magnetic field is generated by applying an electric current to this coil. This magnetic field rotates the electron beam bundle along the beam's traveling direction. The electron beam bundle will be rotated by Lorentz force whose amount is in accordance with the strength of the generated magnetic field.

Therefore, in the electron gun relating to the present embodiment, optimization for parameters becomes possible in order to rotate the electron beam bundle at a desired angle, while keeping the sectional form of the electron beam bundle constant. The stated parameters include such as the magnetic field generated by the solenoid coil, the velocity components of an electron at the time when the electron is passing through the electron lens 36, and the distance that the electron has to travel.

A method for correcting the spot profile of electron beam bundles is described with reference to FIG. 13.

Figures 13A, 13B, 13C:
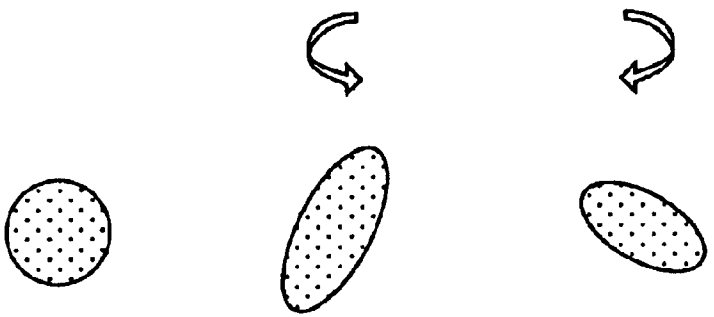
FIGS. 13A–C show sectional forms of the electron beam bundles.
Figure 14:
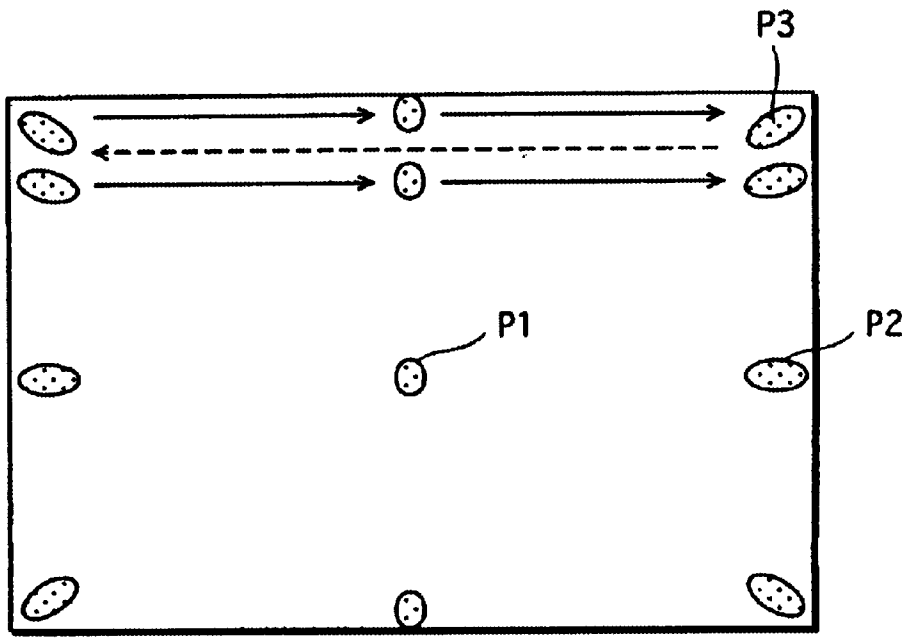
FIG. 14 is a diagram showing the spot profiles on the screen of the CRT.
Figure 15:
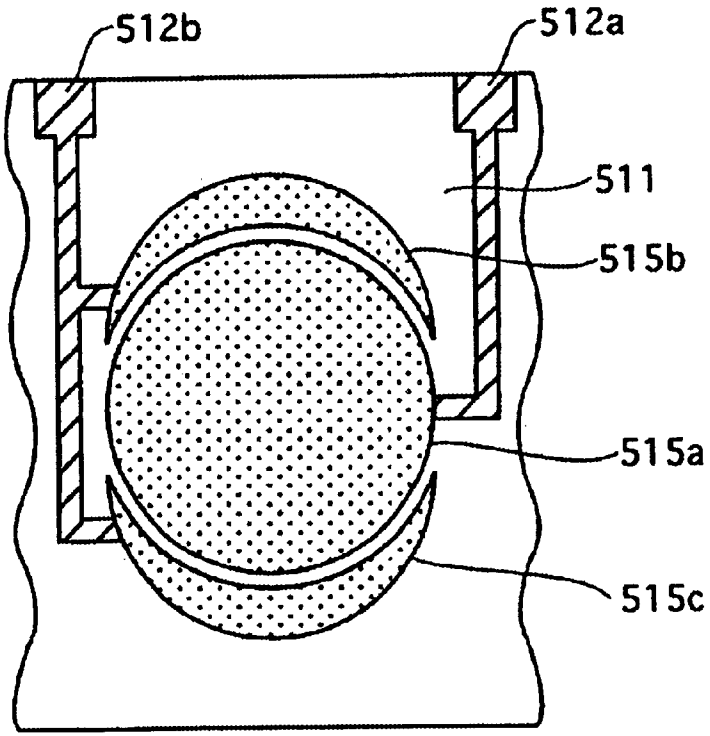
FIG. 15 is a diagram showing the structure of the cathode included in the conventional CRT.

The spot profile shown by FIG. 13A is perfect circle, which is obtained in the center of the screen 3.

When an electron beam bundle reaches the corner of the screen 3 without having been corrected by rotation, the spot profile of the electron beam bundle will be oval and is tilted as shown in FIG. 13B.

Whereas in the present embodiment, it becomes possible to produce the sectional form of an electron beam bundle emitted from the electron gun 1 as illustrated as FIG. 13C, the electron beam bundle having been emitted from the field emission device 10 and then having been converged and rotated by the electron lens 36. By doing so, the spot profile of the electron beam bundle directed to the bottom of the area A1 or to the top of the area A5 in FIG. 5 will be substantially a perfect circle.

The electron emission area selection circuit 203 in FIG. 4 controls the rotation of an electron beam bundle by means of the electron lens 36 as stated in the above. The rotation is synchronized to a vertical signal S2 and horizontal signal S3.

The angle of rotation for the electron beam bundle may be set according to each area on the screen 3 as stated earlier, and may be set according to each pixel. However, it is desirable to calculate the optimal angle and store the optimal angle in the electron emission area selection circuit 203 in advance, so as to enable adjustment for each area of the screen, with use of this table.

Such CRT will have high-resolution performance since it becomes possible to yield a uniform spot profile of electron beam bundle throughout the screen 3.

Note here that the position at which the beam rotation coil R1 is placed within the electron lens 36 is preferably between the grid electrode G5 and the screen 3 such as for limited space. However, the position may be between the field emission device 10 and the grid electrode G1.

In addition, the spot profile of the electron beam bundle was described to be round or oval in the aforementioned FIG. 13. However, the same effect will be obtained with the rectangular spot profile described such as in the first embodiment.

INDUSTRIAL APPLICABILITY

The field emission device of the present invention is useful for realizing an electron gun having high-resolution performance and high luminance, and a cathode ray tube apparatus equipped with such electron gun.

What is claimed is:

1. A field emission device that emits an electron beam bundle to be scanned over a screen, the field emission device including:

a plurality of electron emission zones arranged two dimensionally, each of which is driven independently of the other electron emission zones and emits an electron beam by means of an electric field, wherein one or more of the plurality of electron emission zones are selected to emit electron beams that constitute the electron beam bundle, the selection being performed so as to correct a spot profile of the electron beam bundle on the screen in a case where the spot profile is distorted from a regular shape.

2. The field emission device of claim 1, wherein the electron emission zones are each made up of at least one emitter.

3. The field emission device of claim 2, wherein the electron emission zones are arranged in a matrix configuration.

4. The field emission device of claim 3 further including a substrate, a plurality of row electrodes provided parallel to each other on the substrate, and a plurality of column electrodes parallel to each other and provided over the plurality of row electrodes with an insulating layer in-between, the column electrodes crossing over the row electrodes, control part being of electrically higher resistance than the common line part, and the emitter is electrically connected to one of the common line parts through one of the current control parts.

5. The field emission device of claim 4, wherein one or more of the row electrodes and one or more of the column electrodes are selected, so that an overlapping area is formed between the selected row electrodes and the selected column electrodes, and the electron beam bundle is emitted from emitters included in the overlapping area by applying voltage between the selected row electrodes and the selected column electrodes.

6. The field emission device of claim 4, wherein the substrate is made of a p-type semiconductor material, and the row electrodes have an n-type conductivity.

7. The field emission device of claim 4, wherein the row electrodes are each made of a common line part and a current control part, the common line part being of electrically low resistance, and the current control part being of electrically higher resistance than the common line part, and the emitter is electrically connected to one of the common line parts through one of the currant control parts.

8. The field emission device of claim 7, wherein the current control part is a load resistance element against the emitter, and controls an amount of electric current fed to the emitter.

9. An electron gun that emits an electron beam bundle to be scanned over a screen, comprising:

a field emission device including a plurality of electron emission zones arranged two-dimensionally, each of which being driven independently of the other electron emission zones, and emits an electron beam by means of an electric field; and an electron lens accelerating and converging the electron beam bundle, wherein one or more of the plurality of electron emission zones are selected to emit electron beams that constitute the electron beam bundle, the selection being performed so as to correct a spot profile of the electron beam bundle on the screen in a case where the spot profile is distorted from a regular shape.

10. The electron gun of claim 9, wherein the electron emission zones are each made up of at least one emitter.

11. The electron gun of claim 10, wherein the electron emission zones are arranged in a matrix configuration.

12. The electron gun of claim 11, wherein the field emission device further includes a substrate, a plurality of row electrodes provided parallel to each other on the substrate, and a plurality of column electrodes parallel to each other and provided over the plurality of row electrodes with an insulating layer in-between, the column electrodes crossing over the row electrodes, where the at least one emitter is disposed at each of crossover portions formed between the row electrodes and the column electrodes, so as to protrude from a row electrode.

13. The election gun of claim 12 further including a driving control unit which selects one or more of the column electrodes, so that an overlapping area is formed between the selected row electrodes and the selected column electrodes, and the electron beam bundle is emitted from emitters included in the overlapping area by applying voltage between the selected row electrodes and the selected column electrodes.

14. The electron gun of claim 9, wherein a driving control unit selects one or more of the plurality of electron emission zones so as to select a region of a predetermined shape formed by the selected electron emission zones, and makes emitters included in the region emit the electron beam bundle.

15. The electron gun of claim 14, wherein the driving control unit performs the selection of the region, according to a relative position between the electron lens and the field emission device, in at least one of a horizontal direction and a vertical direction.

16. The electron gun of claim 14 further including a detection unit that detects distortion of a spot profile of the electron beam bundle emitted from the emitters, wherein the driving control unit performs the selection of the region in order to correct the distortion of a spot profile of the electron beam bundle, based on a detection result of the detection unit.

17. The electron gun of claim 16, wherein the electron lens includes a rotation unit operable to rotate the electron beam bundle around an axis that coincides with the direction of the electron beam bundle, so as to correct the distortion based on the detection result of the detection unit.

18. The electron gun of claim 16, wherein the detection unit detects the distortion of the electron beam bundle due to a terrestrial magnetism.

19. The electron gun of claim 14, wherein the driving control unit selects the region according to an inputted luminance signal.

20. The electron gun of claim 14, wherein the driving control unit selects the region, according to a length of driving time.

21. The electron gun of claim 12, wherein a potential difference between the row electrodes and the column electrodes is set to be higher in the region than elsewhere.

22. The electron gun of claim 9, wherein at least one of the field emission device and the electron lens includes a differential exhausting unit having a gas absorptive property.

23. The electron gun of claim 22, wherein the differential exhausting unit makes a degree of vacuum higher at least in the vicinity of the field emission device than a degree of vacuum elsewhere.

24. The electron gun of claim 22, wherein the differential exhausting unit is made of a nonevaporation getter material.

25. The electron gun of claim 24, wherein the getter material is formed on a surface of at least one of the field emission device and the electron lens.

26. The electron gun of claim 25, wherein the getter material is a frittable getter material.

27. The electron gun of claim 10, wherein a driving control unit selects one or more of the plurality of electron emission zones so as to select a region of a predetermined shape formed by the selected electron emission zones, and makes emitters included in the region emit the electron beam bundle.

28. The electron gun of claim 11, wherein a driving control unit selects one or more of the plurality or electron emission zones so as to select a region of a predetermined shape formed by the selected electron emission zones, and makes emitters included in the region emit the electron beam bundle.

29. The electron gun of claim 12, wherein a driving control unit selects one or more of the plurality of electron emission zones so as to select a region of a predetermined shape formed by the selected electron emission zones, and makes emitters included in the region emit the electron beam bundle.

30. The electron gun of claim 13, wherein the driving control unit selects one or more of the plurality of electron emission zones so as to select a region of a predetermined shape formed by the selected electron emission zones, and makes emitters included in the region emit the electron beam bundle.

31. A cathode ray tube apparatus comprising:

a field emission device where a plurality of electron emission zones are arranged two-dimensionally, each electron emission zone emitting, by means of an electric field, an electron beam independently of the other electron emission zones;

an electron lens accelerating and converging electron beams emitted in a bundler; and a deflection yoke deflecting the electron beam bundle before the electron beam bundle is scanned over a screen which is placed to oppose the deflection yoke.

32. The cathode ray tube apparatus of claim 31, wherein a driving control unit selects one or more of the plurality of electron emission zones so as to select a region of a predetermined shape formed by the selected electron emission zones, and makes emitters included in the region emit the electron beam bundle.

33. The cathode ray tube apparatus of claim 32 further including a detection unit that detects distortion of a spot profile of the electron beam bundle emitted from the emitters, wherein the driving control unit performs the selection of the region in order to correct the distortion of a spot profile of the electron beam bundle, based on a detection result of the detection unit.

34. The cathode ray tube apparatus of claim 33, wherein the electron lens includes a rotation unit operable to rotate the electron beam bundle around an axis that coincides with the direction of the electron beam bundle, so as to correct the distortion based on the detection result of the detection unit.

35. The cathode ray tube apparatus of claim 33, wherein the detection unit detects the distortion of the electron beam bundle due to a terrestrial magnetism.

36. The cathode ray tube apparatus of claim 31, wherein the electron emission zones are each made up of at least one emitter.

37. The cathode ray tube apparatus at claim 36, wherein the electron emission zones are arranged in a matrix configuration.

38. The cathode ray tube apparatus of claim 37, wherein the field emission device further includes a substrate, a plurality of row electrodes provided parallel to each other on the substrate, and a plurality of column electrodes parallel to each other and provided over the plurality of row electrodes with an insulating layer in-between, the column electrodes crossing over the row electrodes, where the at least one emitter is disposed at each of crossover portions formed between the row electrodes and the column electrodes, so as to protrude from a row electrode.

39. The cathode ray tube apparatus of claim 38 further including a driving control unit which selects one or more of the column electrodes, so that an overlapping area is formed between the selected row electrodes and the selected column electrodes, and the electron beam bundle is emitted from emitters included in the overlapping area by applying voltage between the selected row electrodes and the selected column electrodes.

40. The cathode ray tube apparatus of claim 39, wherein the driving control unit selects the region according to an inputted luminance signal.

41. The cathode ray tube apparatus of claim 39, wherein the driving control unit selects the region, according to a length of driving time.

42. The cathode ray tube apparatus of claim 38, wherein a driving control unit selects one or more of the plurality of electron emission zones so as to select a region of a predetermined shape formed by the selected electron emission zones, and makes emitters included in the region emit the electron beam bundle.

43. The cathode ray tube apparatus of claim 39, wherein the driving control unit selects one or more of the plurality of electron emission zones so as to select a region of a predetermined shape formed by the selected electron emission zones, and makes emitters included in the region emit the electron beam bundle.

44. The cathode ray tube apparatus of claim 36, wherein a driving control unit selects one or more of the plurality of electron emission zones so as to select a region of a predetermined shape formed by the selected electron emission zones, and makes emitters included in the region emit the electron beam bundle.

45. The cathode ray tube apparatus of claim 37, wherein a driving control unit selects one or more of the plurality of electron emission zones so as to select a region of a predetermined shape formed by the selected electron emission zones, and makes emitters included in the region emit the electron beam bundle.

46. A method of producing a cathode ray tube, comprising:

a storing step of storing an electron gun in a neck part of a funnel, a field emission device being included in the electron gun and emitting an electron beam bundle by means of an electric field;

a connecting step of connecting the funnel to a panel; and an aging step of degassing a space formed between the funnel and the panel, wherein the field emission device has a plurality of electron emission zones arranged two-dimensionally, each of which emitting, by means of an electric field, an electron beam independently of the other electron emission zones, and the aging step is preformed by generating ion by making electron emission zones positioning in an edge of the field emission device emit electron beams, and making the electron emission zones from which the electron beams are emitted absorb the generated ion.

* * * * *